United States Patent [19]

Doerer

[11] 3,948,708

[45] Apr. 6, 1976

[54] METHOD OF FORMING A PANEL

[75] Inventor: Richard P. Doerer, Grosse Pointe, Mich.

[73] Assignee: Van Dresser Corporation, Detroit, Mich.

[22] Filed: Mar. 26, 1973

[21] Appl. No.: 344,869

[52] U.S. Cl. ..... 156/196; 144/309 B; 144/315 R; 144/320 R; 144/327; 156/214

[51] Int. Cl.[2] ..... B31F 1/00

[58] Field of Search ..... 156/196, 214, 245, 223, 156/285, 212, 321, 322; 144/309 R, 320, 324, 327; 264/156, 322; 161/250

[56] References Cited

UNITED STATES PATENTS

| | | | |
|---|---|---|---|
| 2,338,685 | 1/1944 | Dee | 144/327 X |
| 3,378,422 | 4/1968 | Kemp | 156/285 X |
| 3,423,267 | 1/1969 | Munk | 156/214 |
| 3,507,685 | 4/1970 | Banerjee | 161/250 X |
| 3,627,608 | 12/1969 | Steiner et al. | 156/214 X |
| 3,630,797 | 12/1971 | Mallory et al. | 156/322 X |
| 3,654,019 | 4/1972 | Cusick | 156/285 |
| 3,675,692 | 7/1972 | Jeans | 144/327 X |
| 3,758,357 | 9/1973 | Akerson et al. | 156/196 |

*Primary Examiner*—William A. Powell
*Assistant Examiner*—David A. Simmons
*Attorney, Agent, or Firm*—Whittemore, Hulbert & Belknap

[57] ABSTRACT

A method of forming a flexible sheetlike structure such as an automotive head-liner by treating a sheet of fiberboard or other woodlike fibrous material with water at an elevated temperature to make the sheet sufficiently ductile to permit forming without tearing or blowing, and placing the water-treated sheet between heated dies to form the sheet to a compound curvature by the application of heat and pressure. The sheet may or may not be perforated. The method also includes finishing one side of the die-formed sheet by securing a decorative or sound-absorbing layer thereto. The sheet is placed on a support and the layer is applied over the adhesive coated upper surface of the sheet. A cover is draped over the support to provide an air seal over the layer and sheet and is drawn against the support by differential pressure, either pressure or vacuum to press the layer against the sheet and adhere the two together.

4 Claims, 9 Drawing Figures

FIG.1
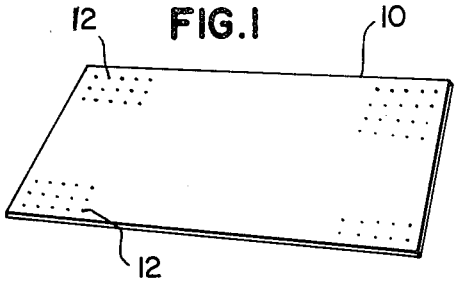
FIG.2
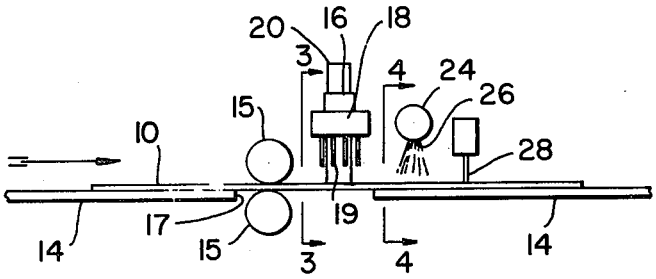
FIG.3
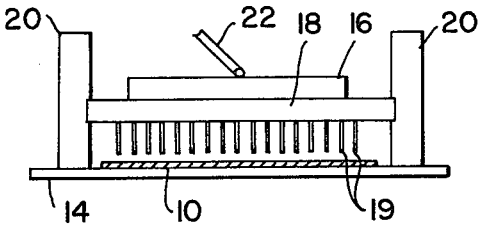
FIG.4
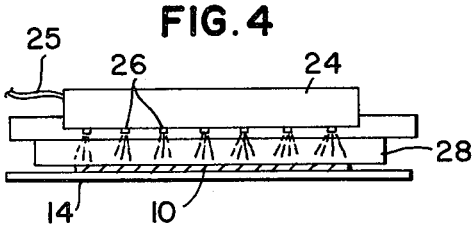
FIG.5
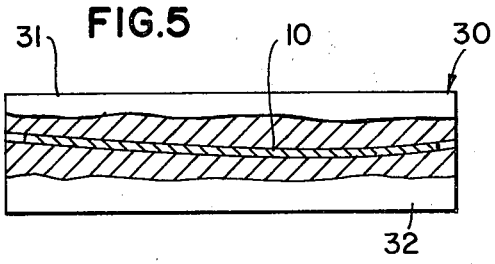
FIG.6
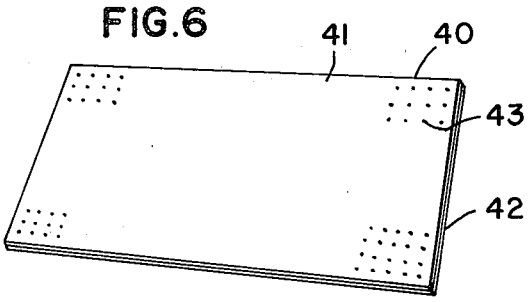
FIG.7
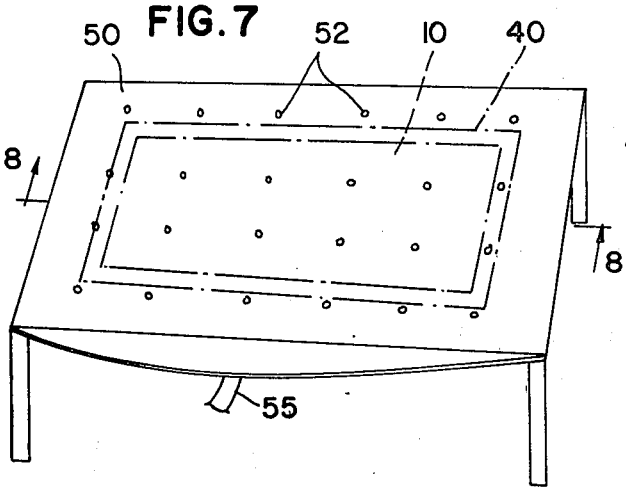
FIG.8
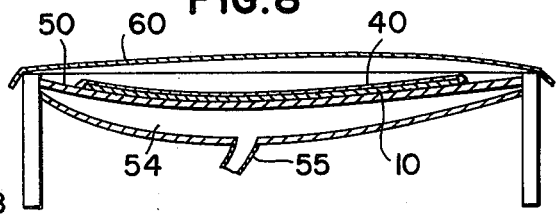
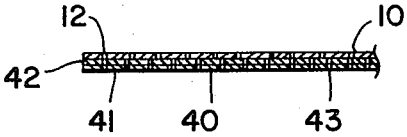
FIG.9

METHOD OF FORMING A PANEL

BACKGROUND AND SUMMARY OF THE INVENTION

The method of this invention is employed to reform fiberboard or hardboard panels into curved self-supporting structures such as automotive head-liners. Fiberboard or hardboard panels usually include waxes and resin binders which impart a substantial resistance to bending so that the sheet has a tendency to tear when deformed or re-formed into a compound curvature. Moreover, the fiberboard panels tend to return to their original flat shape after being re-formed unless the fibers are actually shifted during the re-forming process.

The method includes applying water to a sheet of woodlike fibrous material, such as panels of ordinary fiberboard or hardboard which may or may not be perforated. The water is applied at an elevated temperature to the sheet in an amount sufficient to render the sheet ductile enough to permit forming without tearing or blowing and thereafter the water-treated sheet is formed to the desired curvature in a die under pressure. A water temperature between about 180°F. and about 200°F. is preferred in order to break down or soften the waxes and binders which permeate the body of the fiberboard or hardboard material. Temperatures as low as 120° are sufficient for the purpose, however.

The panel need not have perforations. However, the presence of perforations to some extent will serve to weaken the structural makeup of the panel and thereby aid in permanent re-forming. Such perforations also provide voids into which fibers may be shifted during re-forming and furthermore provide a means for entry and escape of the water into and out of the body of the sheet during the re-forming process.

The water reduces the rigidity of the waxes and binders, whether thermoplastic or thermosetting, and moistens and softens the structure of the fibrous material itself, but does not saturate or soak the panel material to an extent that would cause blowing when the panel is reformed in the hot press. It is desirable that the panel be sufficiently moistened so as to be rendered ductile to permit forming without tearing, and yet not overtreated with water to the extent of soaking the internal structure and making it likely to blow when being formed. By "blowing" is meant the rupture of the panel from internal pressure caused by an excess of steam generated by too much water in the body of the panel when heated in the press.

The panel is preferably formed between heated dies under a pressure sufficient to actually cause material flow of the fibers in the areas of curvature. The re-forming takes place without tearing or blowing. When the panel is removed from the dies, most of the moisture has been driven out and the waxes and resin binders return to a rigid or semi-rigid condition to retain the re-formed shape.

In the preferred embodiment of forming an automotive head-liner, after the panel has been water treated and re-formed in a heated press, a decorative and/or sound-absorbing layer is applied thereto. This is accomplished by placing the re-formed panel upon a contoured support, applying adhesive to the upper surface of the panel, and laying the sound-absorbing layer over the adhesive coated sheet. The layer is adhered to the sheet preferably by draping a cover over the support to form an air seal and applying differential pressure, in this instance vacuum through the support to draw the cover toward the support and against the layer to adhere the layer to the sheet.

The prior art teaches the use of steam to render the panel ductile before placing it between heating dies. Thus in accordance with the prior art the panel is initially placed in a steam chest or chamber. However, in a steam chest, drops of water form and fall on the panel producing concentrated circles of excessive moisture which show up on the finished panel after it has been die formed and dried. The circles of excessive moisture are believed to form high spots by causing swelling of the panel material. The panel high spots tend to become over-compressed in the die and produce slight dimples which show through the sound-absorbing or decorative layer adhered to the panel. Such dimples or show-through marks are undesirable because they produce an unsightly appearance. Wet spots in the board due to drips from the steam chest also tend to show up in the finished panel through a painted surface in instances where the board is painted rather than laminated by adhesive to a sound-absorbing or decorative layer.

Panels treated with water at elevated temperatures rather than in a steam chest prior to die forming have been found to be free of the objection of water marks or wet spots.

In the drawings:

FIG. 1 is a perspective view of a perforated fiberboard panel in its initial generally flat condition.

FIG. 2 is a diagrammatic side elevational view of apparatus for perforating and water-treating the panel.

FIG. 3 is a sectional view taken along the line 3——3 on FIG. 2.

FIG. 4 is a sectional view taken along the line 4——4 on FIG. 2.

FIG. 5 is an elevational view with parts in section of the water-treated panel being re-formed between dies.

FIG. 6 is a perspective view of a sound-absorbing or decorative layer which may be a foam-backed vinyl sheet.

FIG. 7 is a perspective view showing in phantom lines the sound-absorbing or decorative layer laid over the re-formed fiberboard sheet upon a contoured support.

FIG. 8 is a sectional view taken on the line 8——8 on FIG. 7.

FIG. 9 is a fragmentary sectional view of the finished re-formed fiberboard sheet having the sound-absorbing or decorative layer adhered thereto.

Referring now more particularly to the drawings, the panel shown in FIG. 1 is a commercially available fiberboard or hardboard panel 10 which is relatively inexpensive and yet provides a fairly strong resilient structure. Fiberboard panels of this type are commercially available from many sources. The fiberboard is permeated with waxes and is formed from steam exploded wood fibers in a resin binder which may be thermosetting or thermoplastic, making such panels difficult to form into complex or compound curvatures. The resin binder causes the panel to tend to return to its original flat shape, when re-formed. Furthermore, the material of the panel tends to blow when oversoaked or saturated with too much water or to tear when re-formed without wetting. The method of this invention is adapted to wet the panel with a limited amount of water at an elevated temperature to permit re-forming without either tearing or blowing.

The fiberboard panel 10 is adapted to be reformed into a contoured or curved structure, and is particularly suited when re-formed for use in an automotive head-liner, although it should be understood that the invention is not limited to the use of the re-formed panel for such purposes.

The panel is shown in FIG. 1 as having the perforations 12 formed in it. The panel is shown in FIGS. 2–4 during steps in the method in which the perforations are formed and the panel water-treated in one continuous operation. It will be understood however that the perforations may if desired be made in the panel as a separate step prior to water treatment. It will be further understood the perforations may in the broader aspects of the invention, be omitted altogether, although they are beneficial from the standpoint of weakening the resistance of the panel to bending, in other words, making the panel more readily re-formable from the flat to a contoured configuration. Perforations also provide voids for the shifting fibers during re-forming and a means for entry and escape of water.

The perforations may vary in size but in the present instance are about three thirty-seconds of an inch in diameter and are arranged in parallel rows one-quarter inch apart with the perforations in each row themselves spaced one-quarter inch apart and respectively substantially aligned with the perforations in the adjacent rows. The panel in this instance has a thickness of one-tenth of an inch. It will be understood of course that thicker or thinner panels may be used and that other hole diameters and spacing may be employed, although the dimensions here given have been found to be suitable for manufacture and re-forming of automotive head-liners. The panel may be and preferably is perforated and water-treated in one continuous operation as shown in FIGS. 2–4. As seen in those Figures, the panel is advanced intermittently on a table 14 by feed rolls 15 in the direction of the arrow. The conveyor is operated intermittently to advance the panel increments of a predetermined distance. A perforating device 16 is operated while the panel is stationary to form one or several rows of perforations in the panel, and then the panel is advanced by rolls 15 a further increment in preparation for the next operation of the perforating device. The table is interrupted to provide an opening 17 beneath the perforating device. Any suitable intermittent power drive for the incremental operation of the feed rolls may be employed and of course alternatively the feed rolls may even be operated manually if desired although manual operation would not be practical from the standpoint of efficient production.

The perforating device comprises a header 18 disposed above the table so as to extend across the panel and is mounted for vertical reciprocation on uprights 20 on either side of the table. The header carries a plurality of piercing pins 19 which project downwardly therefrom in the spaced relation to one another corresponding to the desired pattern of perforations in the panel. The perforations are formed by the pins between intermittent advances of the panel upon downward movement of the header. Any suitable means including for example the crank 22 may be provided for raising and lowering the header 18.

Located beyond the perforating device in the direction of panel movement is a manifold pipe 24 which extends above the table and across the panel. The manifold pipe is fed with water through hose 25 maintained at an elevated temperature and has outlets or discharge orifices 26 in a row along the underside to discharge water constantly upon the upper surface of the panel during the time that it is intermittently advanced.

The water applied to the panel by the manifold pipe 24 is maintained at an elevated temperature of at least 120°F. but less than 212°F. which is the temperature at which steam will form under the atmospheric conditions in which this method is preferably carried out. The waxes and resin binders are sufficiently softened within this range. The preferred temperature range of the water is 180°F. to 200°F. to more completely soften the waxes and resins in to the center of the panel.

The water is supplied or discharged upon the upper surface of the panel during the entire time it is traveling through the perforating device. During such time, the panel of course is intermittently advanced and then stopped so that the perforating device can form the perforations therein. Thus the water is continuously discharged during the perforating operation upon the upper surface of the panel while the panel is held stationary during perforating and also while it is being advanced.

It is important that enough water be applied to the panel to completely cover its top surface so as to sufficiently moisten the fibrous and resin structure of the entire panel to render it ductile in order that it may be subsequently formed in the press without tearing. To insure that the entire upper surface of the panel is subjected to the water treatment, a wiper blade 28 disposed rearwardly of the water manifold pipe 24 extends above the table across the panel and engages the upper surface of the panel across the full width thereof to uniformly spread the water thereover. Some water is of course wiped off. That which is not will enter the fibrous material of the panel both through its flat top surface, its edges, and by way of the perforations. The perforations thus aid in conducting the water to the internal fibrous structure of the panel. The amount of water entering the panel structure is not so great that there is any possibility of later blowing when heated in the press because any excess is wiped off by the blade 28. There is no danger of the panel being over-treated with water because as stated the excess is wiped away. Actually, just enough water is used to cover the surface. The water temperature selected is such that it will soften the waxes and resin bond holding the fibers of the panel together sufficiently so that the fibers may shift during subsequent re-forming.

Water treatment of the panel in the manner above described is fast and efficient and can be carried out with a minimum of labor, in contrast to the separate steaming of panels in a steam chest as heretofore done.

After being water-treated, the panel may then be re-formed in a press 30 as shown in FIG. 5 without the danger of being torn or of blowing. The press utilized is a heated press and sufficient pressure is used to cause a natural flow of the fibers particularly in the areas of substantial curvature. The conventional automotive head-liner may be formed in a 300-ton press in approximately 1 minute at 475°F. At one or more intervals during the 1-minute period, the press dies 31 and 32 may be opened to de-gas, that is permit the escape of steam driven out of the internal structure of the panel by the heat of the press.

The panels are rendered flexible or bendable almost immediately after leaving the water treatment shown in FIGS. 2–4 and can be moved immediately to the hot press. However, they may be stored for as much as 12 to 24 hours after water treatment and will still retain enough moisture to permit reforming in the hot press after storage or even after a longer period of time if they are covered so as to retain their moisture.

The re-formed panel when taken from the press is substantially dry and will hold its shape. It may be finished as by securing a rectangular sound-insulating or decorative layer 40 to its inner surface.

The layer 40 may for example be formed of a fabric or plastic sheet. Preferably the layer 40 is a vinyl trim cover composed of a sheet of vinyl material 41 which may or may not be backed with a thin layer of foam 42 such as polyurethane or latex. The vinyl trim cover or layer 40 may preferably be perforated as shown by holes 43 of the same or similar diameter to the holes in the fiberboard and spaced the same or different distances than the perforations in the fiberboard. The vinyl trim cover is cut to a slightly larger size than the fiberboard so as to overlap the fiberboard when initially secured thereto, after which the overlapped portions are cut away.

To secure the vinyl trim cover 40 to one side of the fiberboard, one side of the fiberboard is sprayed or coated with an adhesive. A suitable adhesive is a water soluble or water dispersed synthetic resinous adhesive, such for example as resin-latex. The fiberboard is laid upon an upper mold surface 50 preferably contoured to the general shape of the re-formed fiberboard with its adhesive coated side up. The vinyl trim cover 40 is laid over the fiberboard with its foam backing in contact with the adhesive coated surface so that the edges of the vinyl trim cover overlap the edges of the fiberboard. The mold surface 50 has holes 52 communicating with a vacuum chamber 54 therebeneath.

In order to press the foam backing of the vinyl trim cover against the adhesive coated surface of the fiberboard to form a secure bond, an imperforate sheet 60 of plastic or other material is laid over the mold surface 50 to seal around the edges of the mold surface. When vacuum is applied to the chamber 54 through pipe 55 by a suitable vacuum pump, not shown, the space between the mold surface and the cover sheet 60 is evacuated through the holes 52 to draw the cover sheet down tightly against the vinyl trim cover and press it against the fiberboard. The vacuum is applied to the cover sheet through the holes 52 around the edges of the fiberboard and the vinyl trim cover, and also through the holes 52 under the fiberboard by way of the perforations in the fiberboard and in the vinyl trim cover. It has been found that a vacuum on the order of about 5 inches of mercury for 10 to 12 seconds is sufficient to form a good bond between the foam backing and the fiberboard. Thereafter the vacuum is removed and the vinyl trim cover is trimmed so that its edges are flush with the edges of the fiberboard (see FIG. 9). It will be understood that a positive pressure, instead of vacuum, may be used to press the cover sheet against the vinyl trim cover and press the latter against the fiberboard. The head-liner consisting of the re-formed fiberboard 10 and vinyl trim cover 40 is now complete and ready to be installed.

The fiberboard comes out of the press 30 retaining a temperature between about 140°F. and about 200°F. The adhesive is preferably sprayed on the fiberboard and the vinyl trim cover 40 adhered thereto by differential pressure immediately after the fiberboard leaves the press, while the temperature of the fiberboard is still within the elevated temperature range mentioned.

A water soluble adhesive such as the one in the example previously given is particularly well suited to the practice of this method. The heat of the panel accelerates the setting of the adhesive by driving out the water in the adhesive. Accordingly, the adhesive will fully set soon after the vinyl trim cover 40 is secured to it. On the other hand, the cure of the water based adhesive is gradual enough to permit a continuous operation from the press through the adhesive application to the adhesive bonding of the vinyl trim cover to the fiberboard.

Solvent type adhesives, while generally suitable for securing the trim cover to the fiberboard, tend to cure when heated more rapidly than water base adhesives, sometimes too rapidly, and may also produce toxic or flammable fumes which are not produced by water base adhesives.

What I claim as my invention is:

1. A method of forming a curved flexible self-supporting sheetlike structure, comprising the steps of providing a sheet of woodlike fibrous material permeated with waxes and formed of wood fibers in a resin binder and having a substantial resistance to bending, advancing the sheet edgewise into, through and out of a water treatment zone while applying water at a temperature of 180°F. to 212°F. continuously to limited areas of the sheet within said zone progressively from the leading edge to the trailing edge of the sheet to soften the waxes and resin binder and make the sheet sufficiently ductile to permit forming without tearing or blowing, placing the sheet between heated dies and forming a curvature in the sheet by the application of heat and pressure to the opposite sides of said sheet by said dies, and holding the sheet between said dies until the sheet is sufficiently dry to hold its shape.

2. The method defined in claim 1, wherein the water is wiped over the entire area of said sheet by a wiper located beyond the water treatment zone.

3. A method of forming a curved flexible self-supporting sheetlike automotive headliner, comprising the steps of providing a sheet of woodlike fibrous material permeated with waxes and formed of wood fibers in a resin binder and having a substantial resistance to bending, advancing the sheet edgewise into, through and out of a water treatment zone while applying water at a temperature of 180°F. to 212°F. continuously to limited areas of the sheet within said zone progressively from one leading edge to the trailing edge of the sheet to soften the waxes and resin binder and make the sheet sufficiently ductile to permit forming without tearing or blowing, placing the sheet between heated dies and forming a curvature in the sheet by the application of heat and pressure to the opposite sides of said sheet by said dies, holding the sheet between said dies until the sheet is sufficiently dry to hold its shape, removing the sheet from said dies, and then while the sheet is still hot from the dies coating one side of said sheet with an adhesive and adhering a decorative or sound absorbing layer to the adhesive coated side of said sheet, the heat of the sheet promoting curing of the adhesive.

4. The method defined in claim 3, wherein said adhesive is a water soluble adhesive, and said sheet is at a temperature of between about 140°F. and 200°F. when the water soluble adhesive is coated thereon and the layer is adhered thereto as aforesaid.

* * * * *